US011338534B2

(12) United States Patent
Hedberg

(10) Patent No.: US 11,338,534 B2
(45) Date of Patent: May 24, 2022

(54) CUTTING UNIT, WEB OF PACKAGING MATERIAL, AND METHOD FOR CUTTING PREPARATION FEATURES INTO IT

(71) Applicant: Tetra Laval Holdings & Finance S.A., Pully (CH)

(72) Inventor: Torbjörn Hedberg, Staffanstorp (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 330 days.

(21) Appl. No.: 16/302,042

(22) PCT Filed: May 15, 2017

(86) PCT No.: PCT/EP2017/061616
§ 371 (c)(1),
(2) Date: Nov. 15, 2018

(87) PCT Pub. No.: WO2017/198620
PCT Pub. Date: Nov. 23, 2017

(65) Prior Publication Data

US 2019/0152182 A1 May 23, 2019

(30) Foreign Application Priority Data

May 16, 2016 (EP) ..... 16169773

(51) Int. Cl.
*B31B 50/16* (2017.01)
*B31B 50/14* (2017.01)
(Continued)

(52) U.S. Cl.
CPC ..... *B31B 50/16* (2017.08); *B26F 1/384* (2013.01); *B26F 1/40* (2013.01); *B26F 1/44* (2013.01);
(Continued)

(58) Field of Classification Search
CPC ..... B31B 50/16; B31B 50/146; B31B 50/256; B31B 2120/302; B26F 1/384; B26F 1/40;
(Continued)

(56) References Cited

U.S. PATENT DOCUMENTS 2,095,359 A * 10/1937 Dudley ..... B41G 7/003 101/391
2,663,180 A * 12/1953 Benedict ..... C14B 5/02 69/2
(Continued)

FOREIGN PATENT DOCUMENTS

DE 19502164 7/1995
EP 0513576 A1 * 11/1992 ..... B26D 7/2621
(Continued)

OTHER PUBLICATIONS

Extended Search Report for European Application No. 16169772.7 dated Dec. 20, 2016 in 6 pages.
(Continued)

*Primary Examiner* — Thomas M Wittenschlaeger
*Assistant Examiner* — Katie L Gerth
(74) *Attorney, Agent, or Firm* — Knobbe Martens Olson & Bear, LLP

(57) ABSTRACT

A cutting unit for cutting preparation features in a web of sheetlike material is provided. The cutting unit has a first part with a rigid base portion, at least one first cutting tool configured to cut a first preparation feature in the web of sheetlike material, and at least one second cutting tool configured to cut a second preparation feature in the web of sheetlike material. The at least one first and second cutting tools are attached to the base portion and located at a distance from each other, wherein at least one of the at least
(Continued)

one first or second cutting tools is supported by a flexible support that is located in the rigid base portion of the first part.

10 Claims, 6 Drawing Sheets

(51) Int. Cl.

| | |
|---|---|
| ***B31B 50/25*** | (2017.01) |
| ***B26F 1/38*** | (2006.01) |
| ***B26F 1/40*** | (2006.01) |
| ***B26F 1/44*** | (2006.01) |
| *B26F 1/08* | (2006.01) |
| *B26F 1/20* | (2006.01) |
| *B26F 1/18* | (2006.01) |
| *B26F 1/02* | (2006.01) |
| *B31B 120/30* | (2017.01) |

(52) U.S. Cl.
CPC ..... *B31B 50/146* (2017.08); *B31B 50/256* (2017.08); *B26F 1/02* (2013.01); *B26F 1/08* (2013.01); *B26F 1/18* (2013.01); *B26F 1/20* (2013.01); *B26F 2001/4409* (2013.01); *B31B 2120/302* (2017.08)

(58) Field of Classification Search
CPC ..... B26F 1/44; B26F 1/20; B26F 2001/4409; B26F 1/18; B26F 1/02; B26F 1/08; B26D 7/2621
See application file for complete search history.

(56) References Cited

U.S. PATENT DOCUMENTS

| | | | | | |
|---|---|---|---|---|---|
| 3,043,165 | A * | 7/1962 | Tracey | B21D 37/205 | 76/107.8 |
| 3,373,643 | A | 3/1968 | Maximilian | | |
| 3,661,044 | A * | 5/1972 | Duden | B26F 1/08 | 83/100 |
| 3,771,399 | A * | 11/1973 | Aterianus | B26D 7/2628 | 83/348 |
| 3,823,633 | A | 7/1974 | Ross | | |
| 4,073,208 | A * | 2/1978 | Kirkpatrick | B26D 7/20 | 492/53 |
| 4,100,844 | A * | 7/1978 | Spengler | B26F 1/44 | 493/472 |
| 4,112,827 | A * | 9/1978 | Kang | B23P 15/406 | 493/336 |
| 4,116,100 | A * | 9/1978 | Witberg | B26F 1/44 | 83/669 |
| 4,289,055 | A * | 9/1981 | Von Schriltz | B26D 7/20 | 83/347 |
| 4,358,979 | A * | 11/1982 | Kurzbuch | B26D 7/20 | 83/140 |
| 5,047,607 | A * | 9/1991 | Briffod | B23H 7/108 | 219/69.12 |
| 5,471,901 | A * | 12/1995 | Nishiya | B21D 28/24 | 83/136 |
| 5,791,219 | A * | 8/1998 | Ochsner | B26D 7/2614 | 83/331 |
| 5,809,858 | A * | 9/1998 | DeRoo, Sr. | B26D 7/20 | 83/542 |
| 6,106,453 | A * | 8/2000 | Sinn | B26F 1/44 | 493/473 |
| 6,138,710 | A * | 10/2000 | Chomik | A61J 9/04 | 137/512.15 |
| 6,189,414 | B1 * | 2/2001 | Yoshizawa | B23P 15/406 | 76/107.8 |
| 6,203,482 | B1 | 3/2001 | Sandford | | |
| 6,378,409 | B1 * | 4/2002 | Reid | B26D 5/02 | 270/58.07 |
| 7,047,858 | B2 * | 5/2006 | Rohrer | B26D 3/085 | 83/582 |
| 9,636,835 | B2 * | 5/2017 | Buss | B26D 1/22 | |
| 10,391,657 | B2 * | 8/2019 | Ferguson | B26D 1/626 | |
| 10,751,901 | B2 | 8/2020 | Benkö | | |
| 10,850,422 | B2 | 12/2020 | Mårtensson et al. | | |
| 2003/0079594 | A1 * | 5/2003 | Kemper | B26F 1/44 | 83/698.31 |
| 2006/0037452 | A1 * | 2/2006 | Grenier | B26D 7/20 | 83/469 |
| 2009/0100975 | A1 | 4/2009 | Grenier et al. | | |
| 2011/0120283 | A1 * | 5/2011 | Serra Obiol | B26D 7/20 | 83/347 |
| 2012/0055305 | A1 * | 3/2012 | Betti | B26D 7/265 | 83/436.3 |
| 2012/0111166 | A1 * | 5/2012 | Yamada | B26F 1/384 | 83/117 |
| 2012/0132047 | A1 * | 5/2012 | Iori | B26F 1/384 | 83/136 |
| 2013/0036889 | A1 * | 2/2013 | Aichele | B26D 7/2628 | 83/343 |
| 2013/0094891 | A1 * | 4/2013 | Annerstedt | B26D 9/00 | 400/621 |
| 2014/0260438 | A1 * | 9/2014 | Matsumura | B26D 7/02 | 69/2 |
| 2015/0298337 | A1 * | 10/2015 | Durst | B21D 28/04 | 83/697 |
| 2016/0023367 | A1 * | 1/2016 | Secondi | B26D 7/14 | 83/18 |
| 2016/0185005 | A1 * | 6/2016 | Schroder | B26F 1/44 | 493/74 |
| 2016/0332315 | A1 * | 11/2016 | Sim | B29C 37/0092 | |
| 2017/0106555 | A1 * | 4/2017 | Yamamoto | B26F 1/44 | |
| 2017/0232632 | A1 * | 8/2017 | Warll | B26D 7/20 | 83/659 |
| 2018/0001505 | A1 * | 1/2018 | Smithwick, Jr. | B26F 1/44 | |
| 2018/0036899 | A1 * | 2/2018 | Allen | B26F 1/384 | |
| 2018/0178479 | A1 * | 6/2018 | Kellermann | B26D 3/08 | |
| 2019/0152087 | A1 | 5/2019 | Mårtensson et al. | | |
| 2019/0152182 | A1 | 5/2019 | Hedberg | | |
| 2019/0176358 | A1 * | 6/2019 | Benko | B26F 1/44 | |

FOREIGN PATENT DOCUMENTS

| | | |
|---|---|---|
| GB | G8 1303838 | 1/1973 |
| JP | H05138587 | 6/1993 |
| JP | H08-25297 | 1/1996 |
| JP | 2014042944 | 3/2014 |
| RU | 2217298 | 11/2003 |
| SU | 1542706 | 2/1990 |

OTHER PUBLICATIONS

International Search Report for International Application No. PCT/EP2017/061617 dated Jun. 26, 2017 in 3 pages.
Written Opinion of the International Searching Authority for International Application No. PCT/EP2017/061617 dated Jun. 26, 2017 in 4 pages.
International Search Report and Written Opinion for Application No. PCT/EP2017/061618 dated Jul. 4, 2017 in 10 pages.
Extended Search Report for European Application No. 16169773.5 dated Dec. 20, 2016 in 6 pages.
International Search Report and Written Opinion for Application No. PCT/EP2017/061616 dated Jun. 19, 2017 in 8 pages.

* cited by examiner

CUTTING UNIT, WEB OF PACKAGING MATERIAL, AND METHOD FOR CUTTING PREPARATION FEATURES INTO IT

TECHNICAL FIELD

The present invention is related to the field of cutting units and methods for cutting preparation features in a web of sheet like material. Moreover, the present invention is related to a web of sheet like material having preparation features cut by the cutting units.

BACKGROUND

In the field of preparation of web of sheet like materials for the purpose of raising packaging containers for foodstuffs therefrom, several methods are previously known.

In one variant, a roll of web of sheet like material, is transported from a nearby or remote location and fed into a creasing and/or cutting machine. The creasing and/or cutting machine comprises a number of roll pairs, each pair carrying a male and a female die. In some variants, the pair of rolls is only carrying a male and a female creasing pattern. The creasing pattern on both dies, when transferred to a web of sheet like material, will result in a number of crease lines on the sheet like material, which in later production stages facilitate the raising of a container from the sheet like material. A second roll pair may then apply preparation features other than crease lines to the web of sheet like material, such as holes or perforations. In each case, one preparation feature is applied in one roll pair, i.e. a creasing pattern is applied in a first stage, holes are applied in a second stage and possible perforations in a third stage in the corresponding roll pair with male and female dies.

When performing a cutting operation, the protruding cutting elements are located on the male die, while the corresponding recessed portions are located on the female die.

One problem arising from the fact that different cutting and creasing operations are performed at different stages in the cutting/creasing machine is that alignment between, for example, the crease line pattern and the holes cut in the sheet like material will suffer due to alignment and manufacturing tolerances added in each cutting or creasing stage. An even greater problem will occur if several cutting and creasing operations are performed by several male/female rolls at several stages of process. Each cutting/and creasing stage will add its tolerances to the crease line pattern or other preparation feature transferred to the sheet like material. Moreover, each new stage will add more rolls to the cutting and creasing process thereby increasing the cost. One other problem with the application of preparation features in several stages is register holding and web stretch, since the web may not travel around the rolls at uniform speed at each stage and may not be wound tightly around the rolls in each creasing and/or cutting stage.

One related way of solving the alignment problem between two or more cutting operations is presented in the U.S. Pat. No. 6,203,482 to Sandford. Sandford discloses an apparatus for cutting cardboard sheets in such way that a cutting and perforation operation is performed by a pair of cutting dies, where both operations are performed in the same processing step. The end result of the combined cutting and perforation operation is a cardboard which has a lid of which one part is cut into the cardboard and where the remaining part of the lid is perforated for ease tearing off. In order to vary the depth of the perforation, the perforation knives are height adjustable by means of screws.

One drawback of the above solution is that it is not adapted for handling web of sheet like material, but rather individual blanks of carton. This makes the production process necessarily slow. Moreover, in order to set the priority order for the cutting and perforation tools and thus ensure high quality cuts, each tool needs to be separate height adjusted by means of screws, which requires very precise height adjustment. Moreover, if the priority order for the cutting and perforation tools needs to be changed, the heights need to be readjusted by means of screws.

There is thus a need for a solution which ensures proper alignment between different creasing, cutting and perforation operations in a continuous process involving a web of sheet like material which at the same times ensures high-quality preparation features with relaxed alignment requirements between the different cutting and creasing tools. Also, there is a need for a cost-effective solution where the wear of the cutting and perforation tools will be more uniform.

One additional problem arising from several simultaneous creasing and cutting operations in an industrial process is that the cutting tools wear out differently over time. Thus, for example the whole cutting knife may become blunt much earlier than the perforating knives leading to unsatisfactory preparation features on the sheet like material.

Hence, there is a need for a solution where both alignment between the different cutting and creasing operations is achieved and where the wear of the cutting and creasing tools is more uniform.

SUMMARY

An object of the present invention is to solve the above-mentioned problem of prior art systems.

These and other advantages of the present invention will become more apparent by studying the following detailed description below.

According to a first aspect, a cutting unit for cutting preparation features in a web of sheetlike material is provided. The cutting unit comprises a first part with a rigid base portion, at least one first cutting tool configured to cut a first preparation feature in the web of sheetlike material, and at least one second cutting tool configured to cut a second preparation feature in the web of sheetlike material. The at least one first and second cutting tools are attached to the base portion and located at a distance from each other, wherein at least one of the first or second cutting tools is supported by a flexible support and wherein the flexible support is located in the rigid base portion of the first part.

In an embodiment the cutting tool further comprises a second part with at least one first rigid base portion, the second part being configured, in operation, to cooperate with the first part and the web of sheetlike material there between, such that when the first and second parts when pressed against the sheetlike material produce at least two preparation features on the packaging material. The second part thus forms an anvil for the first part, whereby precision and accuracy for the operation of the cutting unit can be improved.

The first rigid base portion in the second part may be supported by a flexible support, different from the flexible support in the first part. This allows for a relaxation of the height adjustment requirements for the first and second cutting tools in order to obtain essentially uniform wear over time.

The first part may comprise at least one third cutting tool configured to cut a third preparation feature in the web of sheetlike material, different from the first and second preparation features.

The first and second cutting tools may be supported by a first and second flexible support, respectively and wherein the hardness of the material of the first flexible support is equal to the hardness of the material of the second flexible support.

In another embodiment the first and second cutting tools are supported by a first and second flexible support, respectively and wherein the hardness of the material of the first flexible support is different from the hardness of the material of the second flexible support. Selecting the suitable hardness of the respective flexible members allows adjustment of the wear of each cutting tool such that a uniform wear may be obtained.

In an embodiment the first, second and third cutting tools are supported by a first, second and third flexible support respectively, and wherein the materials for the flexible supports each have a different hardness.

The first cutting tool may have a cylindrical shape and protrudes from the base portion. Hence the first cutting tool may be used to provide holes in the web of sheetlike material.

The second cutting tool may comprise a plurality of protrusions circularly or elliptically arranged at a distance from each other. The second cutting tool may thus be used to provide a perforation to the web of sheetlike material.

According to a second aspect a web of sheetlike material is provided. The web of sheetlike material comprises a plurality of crease lines along which the sheetlike material can be folded into a container, the web of sheetlike material further comprising a first and a second preparation feature aligned with each other. The first and second preparation features are applied by a cutting unit according to the first aspect described above.

According to a third aspect a method for cutting preparation features in a web of sheetlike material is provided. The method comprises: receiving a web of sheetlike material at a cutting and/or creasing station; passing the web of sheetlike material between a first and second parts of a cutting unit, located at a first and second cutting and/or creasing rolls, wherein the first unit comprises at least one first and at least one second cutting tool and where the second unit comprises an anvil against which the web of sheetlike material and the first part is pressed; pressing the two cutting and/or creasing rolls against the web of sheetlike material and against each other and; producing at least one first and one second preparation feature aligned with each other. In this method at least one of the first or second cutting tools are supported by a flexible support.

DETAILED DESCRIPTION

In the following detailed description example embodiments of the present invention are explained with reference to the accompanying drawings. It should be pointed out that these examples are for illustration purposes only and that they should not be construed as limitations of the present invention. Ultimately, the present invention is only limited by the accompanying claims.

Figure 1A:
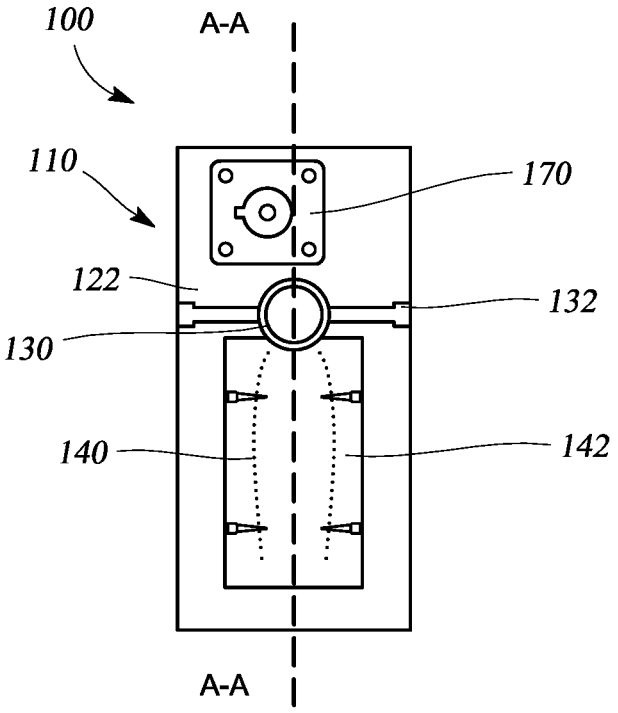
FIG. 1A displays a first embodiment of the cutting unit in a top view.
Figure 1B:
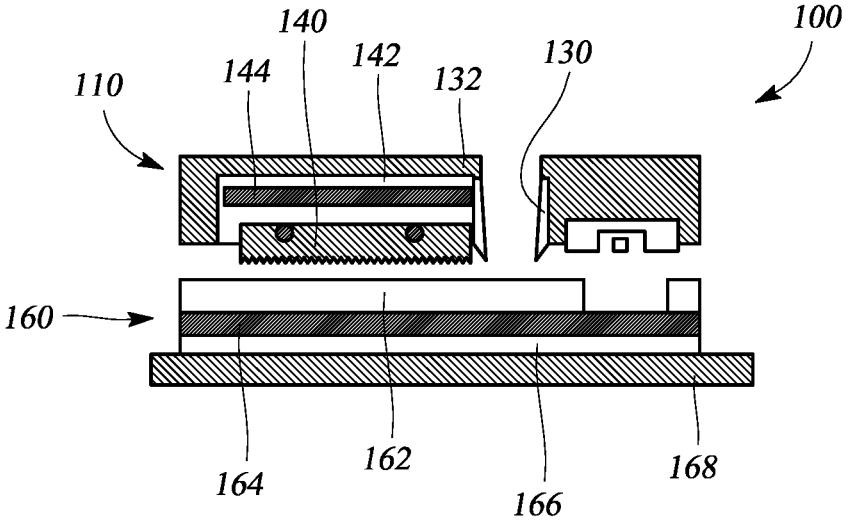
FIG. 1B displays the embodiment for the cutting unit from FIG. 1A in a sectional side view.
Figure 1C:
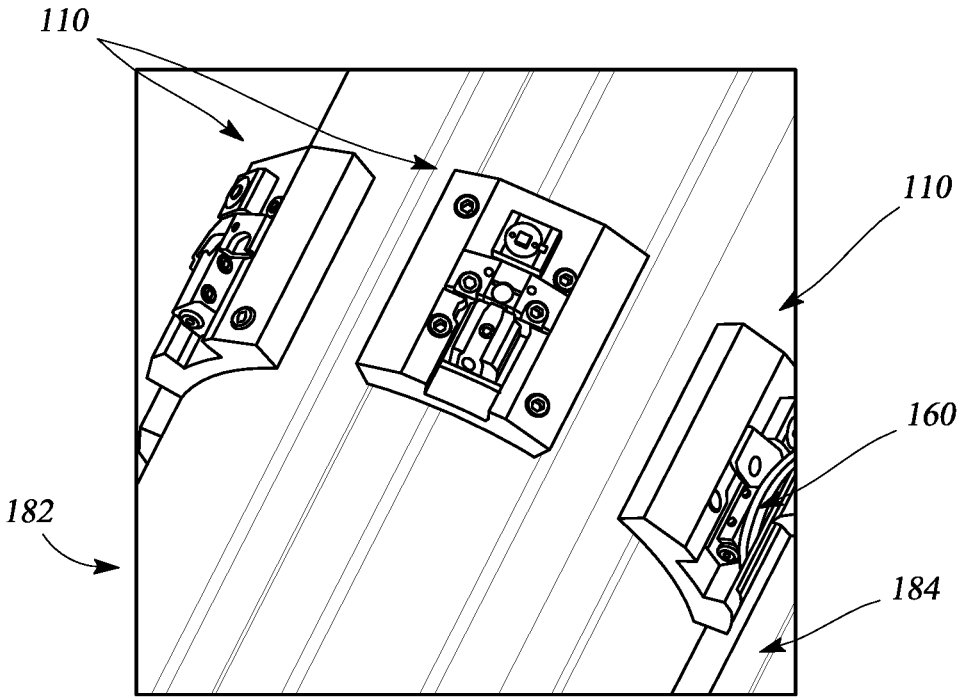
FIG. 1C displays the embodiment for the cutting unit from FIG. 1A in a perspective view.
Figure 1D:
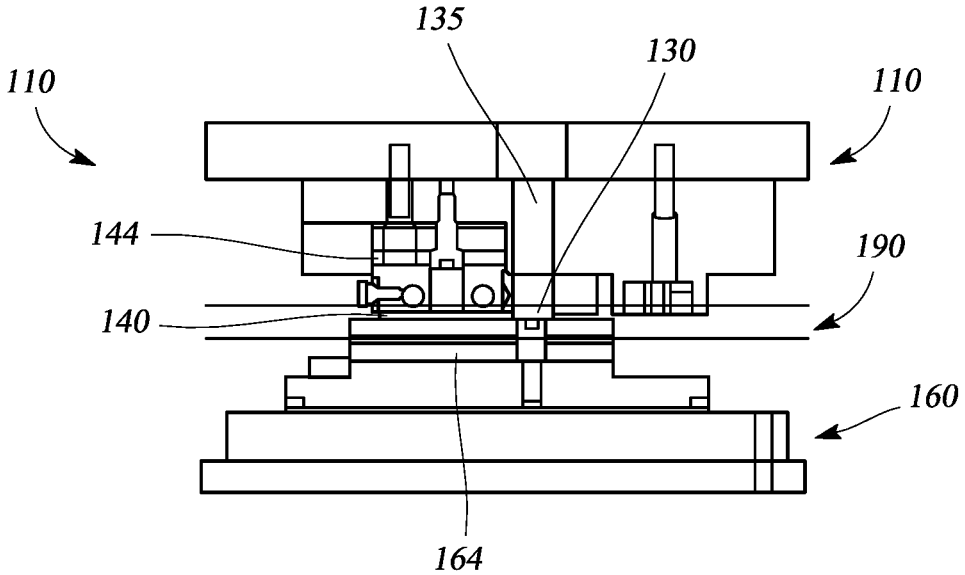
FIG. 1D is a cross-sectional view of the cutting unit according to the embodiment shown in FIGS. 1A-C.

Now, FIG. 1A displays a first embodiment of the cutting unit 100 in a top view. In this top view, only the male first part 110 is shown, while the female second part is shown in FIGS. 1B-1D as well.

As can be seen in the figure, the male first part 110 comprises a first cutting tool 130 in the form of a circular knife 130 and second cutting tool 140 in the form of a series of protrusions with a sharp edge which performs a perforation function. The male first part 110 comprises a base plate 122 supporting both cutting tools 130, 140. Optionally, the male first part 110 also comprises a magnetizer 170 for magnetizing portions on the packaging material containing magnetic particles passing through the cutting unit 110 for the purpose of alignment of the features cut into the packaging material with other preparation features, such as crease lines already present on the packaging material. Also, the magnetized particles may be magnetized in such a way that specific information about the packaging material is transferred.

Returning to the cutting tools 130, 140, the first cutting tool 130 is cylindrical and located in a cylindrical bore in the male first part 110. Also, the first cutting tool 130 is supported by a lower section of the base plate 122 (indicated by reference number 132 in FIG. 1B). The main task of the first cutting tool 130 is to punch a hole into a web of packaging material passing between the male and female parts (indicated by reference numeral 160 in FIG. 1B) of the cutting unit 100 at certain predefined distances, where the hole will serve as a pouring spout for packaging containers folded from blanks cut from the web of packaging material.

As can be seen in FIG. 1A, the second cutting tool 140 comprises two curved halves arranged in a symmetrical fashion in relation to a central axis A-A. As mentioned earlier, both halves of the second cutting tool 140 comprise a number of protrusions spaced apart from each other and serving as a perforation knife for cutting through a web of packaging material at certain predefined locations. In this embodiment, the height of the protrusions is such that when perforating the web of packaging material the perforations will reach to a certain depth of the packaging material, leaving some parts of it intact. The protrusions of the second cutting tool 140 are housed in a second base portion 142 of the base 122. The main function of the second cutting tool 140 is to perforate the packaging material such that a certain section near the punched hole can be torn off.

It should however be realized that different shapes and configurations of the cutting tools 130, 140 could be utilized, such as e.g. straight or curved slits or perforations, depending on the selected application.

As can be seen from FIG. 1A, the first and second cutting tools 130, 140 are aligned with each other, such that the central axis A-A for the second cutting tool 140 also passes through the center of the first cutting tool 130. This alignment is achieved by having both cutting tools 130, 140 integrated in the same cutting unit 100, such that both cutting operations are performed in the cutting step on the web of packaging material. Since in one embodiment, the pouring hole is covered by a plastic closure which usually is injection moulded and which may serve as a tag which when pulled will tear off the perforated section in the packaging material for the purpose of opening the pouring section on a packaging container raised from the packaging material which has been cut by the cutting unit 100. It should be mentioned that the pattern along which the protrusions of the second cutting unit 140 are distributed, may vary in shape and application depending on the type of container that is to be raised from the packaging material being cut by the first and second cutting tools 130 and 140.

FIG. 1B displays a sectional side view of the cutting unit 100. Besides the features already visible from FIG. 1A, the female second part 160 of the cutting unit 100 comprises an anvil 162 supported by a flexible material 164 sandwiched between the anvil 162 and upper base portion 166 of the female second cutting unit 160. Also, the entire structure consisting of the anvil 162, the flexible material support 164 and lower upper portion 166 are located on a lower base portion 168.

Moreover, FIG. 1B displays an embodiment of the cutting unit 100 where the second cutting tool 140 is supported by a flexible material 144 which may or may not be the same as the flexible material 164 in the female second cutting part 160 of the cutting unit 100. Also, the thickness of the flexible materials 144 and 164 may be the same or different depending on the application.

The main functionality of the flexible support 144 for the second cutting tool 140 is to define a cutting priority for the two cutting tools 130, 140 such that the unsupported tool will have the highest priority and provide the best cut if the entire cutting system is set after this cutting tool. Usually, it is the first cutting tool 130 (the cylindrical knife in this case) that is given priority. However, it usually wears out the quickest, so that with the help of the flexible support 144 for the second cutting tool 140, the wear of both cutting tools 130, 140 will be evened out over time.

Moreover, the flexible support 164 in the female second part 160 serves the purpose of relaxing the conditions of height adjustment of the first and second cutting tools 130, 140 in order to obtain essentially uniform wear over time. Thus, the thickness of the flexible support 144 needs not to be adjusted with a high degree of accuracy in order to safeguard uniform wear of both cutting tools 130, 140.

It should be mentioned that in the most general sense, the flexible support defines the cutting priority for the two cutting tools 130, 140, such that in some embodiments, the second cutting tool 140 performing the perforation on the packaging material may be given priority over the first cutting tool 130 performing the hole punching on the packaging material. Moreover, there may be more than one perforation and cutting tool on the cutting unit 100, which will be shown in example embodiments further down in the text.

FIG. 1C displays a cylindrical cutting die 182 carrying the male first part 110. The cutting die 182 is assumed to interact with a corresponding cylindrical cutting die 184 carrying the female second part 160 shown in FIG. 1B.

Although not shown in FIG. 1C, the cutting die 182 and the associated female cutting die 184 may also comprise a male and female creasing pattern to be transferred to a web of packaging material passing between the two dies. In this fashion, both a creasing pattern, a punched hole and a perforation may be transferred to the web of packaging material in one step, leading to better alignment between these preparation features than if they were applied in separate converting steps.

Now, as seen from FIG. 1C several male first parts 110 and correspondingly, several female second parts 160 are attached to the cutting dies 182, 184, such that when a web of packaging material passes in the nip between the two dies 182, 184, several holes and perforations may be cut into the packaging material in a short period of time. The joining of the male and female parts 110, 160 are shown in the lower right-hand corner of FIG. 1C.

FIG. 1D illustrates the case when a hole and a perforation are cut into a web of packaging material shown as the two parallel lines 190 sandwiched between the male first part 110 and the female second part 160 of the cutting unit 100. As can be seen from the figure, the second cutting tool 140 is supported by a flexible material 144, while the first cutting tool 130 is located in a cylindrical bore 135 in the male first part 110. It cuts through the packaging material 190 from one side, while the female second part 160 presses against the packaging material 190 from the other side.

The female second part 160 is supported by the flexible material 164 which has the effect that height adjustment between the cutting tool supported by the flexible support and the non-supported cutting tool does not have to be exact to ensure uniform wear over time.

Figure 2:
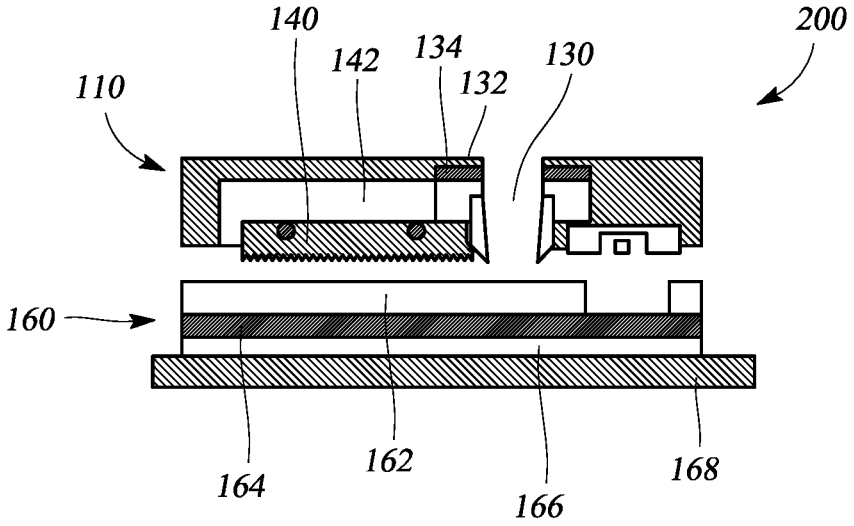
FIG. 2 displays a second embodiment of the cutting unit in a sectional side view.

FIG. 2 displays a second embodiment of the cutting unit, where the cutting unit 200 is very similar to the cutting unit 100 displayed in FIGS. 1A-1D, but where the first cutting tool 130 is supported by a flexible support 134, while the second cutting tool 140 has not a flexible support, but instead rests directly on a base portion 142. In this fashion, the second cutting tool 140 is given cutting priority. This embodiment is thus particularly advantageous for systems and applications requiring the perforation to be perfectly cut, while other cuts are less prioritized.

The remaining parts of the cutting unit 200 are identical to those of the cutting unit 100 in FIGS. 1A-1D.

FIG. 3-8 illustrate some alternative embodiments of the cutting unit where different cutting tools are given different priorities and where some female second parts are unsupported and some are supported by the flexible support.

Figure 3:
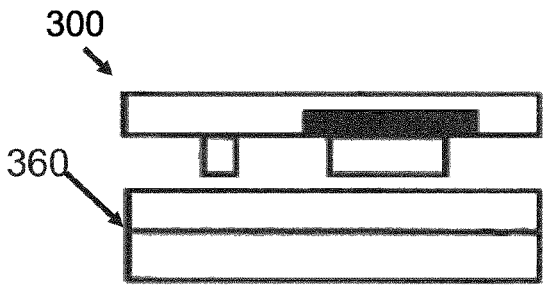
FIGS. 3-8 display other possible embodiments of the cutting unit.

FIG. 3 illustrates a cutting unit 300 with a hard anvil, i.e. where the female second part 360 is not supported by a flexible support. This embodiment of the cutting unit 300 will require some adjustment of the height and possibly also the material of the flexible support 144 in order to ensure more or less uniform wear of the first and second cutting tools 130 and 140. In this embodiment, the first cutting tool 130 is give priority, since it is not supported by the flexible support.

Figure 4:
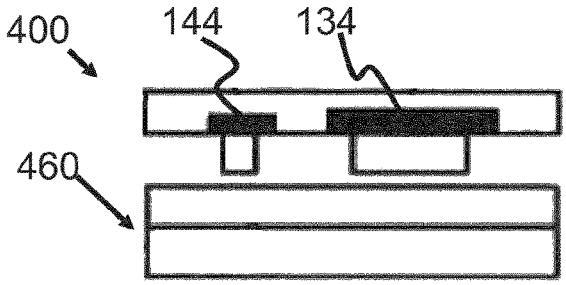

FIG. 4 illustrates and embodiment where both the first and the second cutting tools 130, 140 are supported by a flexible support 134, 144 respectively. The hardness of the material for the flexible support may be the same, but the flexible supports 134, 144 may be different in height, thus giving different cutting priority to the first and second cutting tools 130,140. However, the flexible supports 134, 144 may also be made from materials which have different hardness, where the material with a greater hardness will give the cutting tool supported by it a higher cutting priority.

Figure 5:
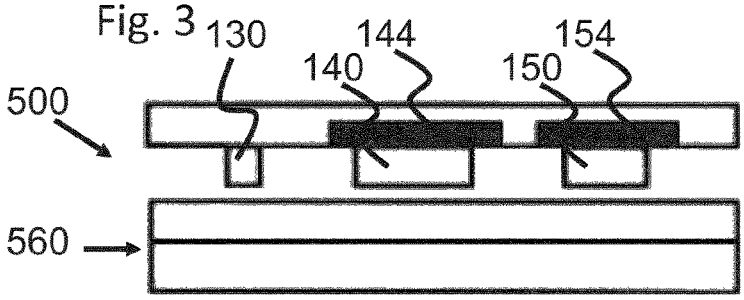

FIG. 5 illustrates an embodiment of the cutting unit 500, in which embodiment the cutting unit 500 comprises a hard anvil 560 (hence no flexible support) and three cutting tools 130, 140 and 150. Of these the first cutting tool 130 may perform the hole punching function, while the other two 140 and 150 may perform perforations on the packaging material. In this fashion, several cutting and perforation actions may be performed in one step keeping them aligned. As can be seen in FIG. 5 the second and third cutting tools 140, 150 are elastically supported by means of a respective flexible support.

Figure 6:
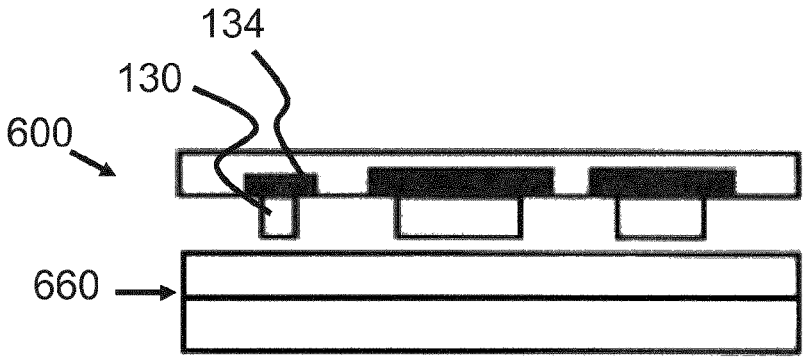

FIG. 6 illustrates an embodiment of the cutting unit, where the cutting unit 600 comprises three cutting tools 130, 140 and 150 and wherein all three cutting tools are supported by their own flexible support which may vary in height and be made of materials with different hardness. Varying the hardness of the flexible support will change the cutting priority for the three cutting tools. In such a way, the wear of the three cutting tools can be adjusted so that over time it will be more or less uniform. In this embodiment, the anvil 660 is not supported by a flexible support and thus may be called a hard anvil.

Figure 7:
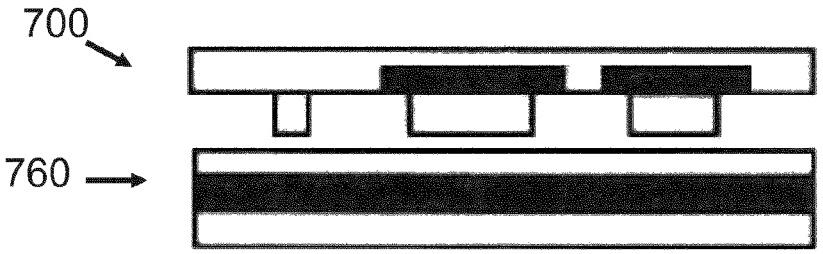

FIG. 7 illustrates an embodiment of the cutting unit, where the cutting unit 700 is very similar to the one shown in FIG. 5, but where the anvil of the female second part 760 is supported by the flexible support 764.

Figure 8:
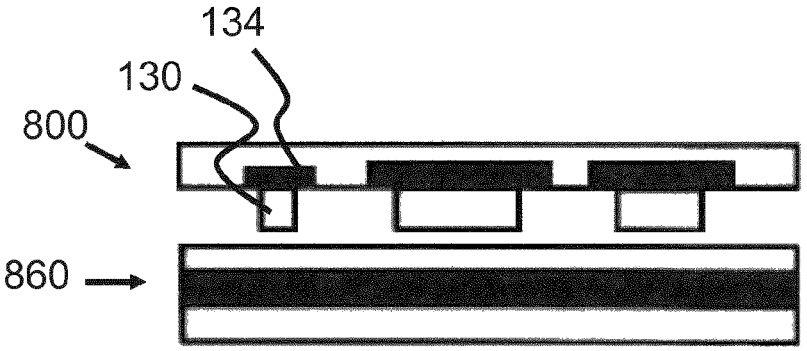

Finally, FIG. 8 illustrates yet another embodiment of the cutting unit 800, in which the cutting unit 800 is very similar to the cutting unit 700 in FIG. 7. However, the first cutting tool 130 is also supported by a flexible support 134 and is given cutting priority over the second and third cutting tools 140 and 150 by a selected material hardness and thickness. The flexible supports for the second and thirds cutting units may be also made from materials with different hardness to ensure uniform wear of the cutting tools. Also in this case, the anvil in the female second part is supported by the flexible support.

It should be mentioned that some examples of the material from which the flexible support is made are rubber, springs or other flexible materials.

Also, it may be added that the cutting tools in the male first part and/or the anvils in the female second part the support may be gas suspended, e.g. by incorporating a gas cushion in the flexible support.

Also worth mentioning is that the first and second male and female parts of the cutting unit may be modular, thus they may be replaced with male and female parts which have different supports from the ones used and may cut different types of holes and perforations and also different numbers of holes and perforations into the packaging material, depending on need.

The cutting unit described above has proven to be particularly advantageous for high speed operation, where a web speed of well above 400 meters per minute is utilized. Still for this high speed accurate cutting is accomplished.

Figure 9:
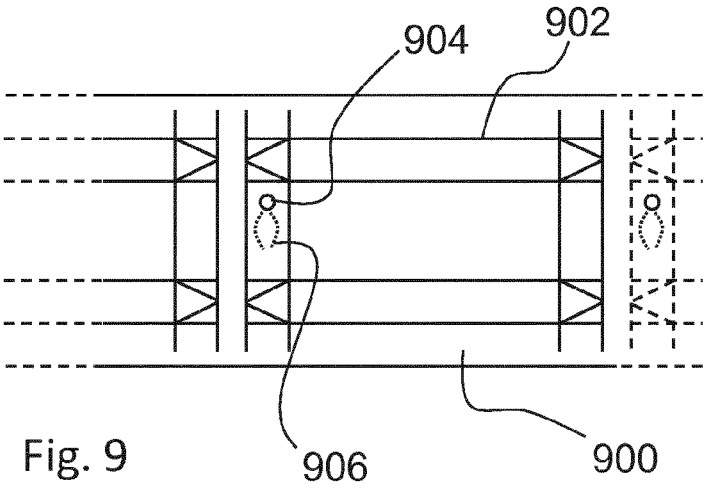
FIG. 9 is a top view of a web of sheetlike material according to an embodiment.

Now turning to FIG. 9 a web 900 of sheetlike material is provided. The web of sheetlike material comprises a plurality of crease lines 902 along which the sheetlike material can be folded into a container. The web 900 of sheetlike material further comprising a first 904 and a second 906 preparation feature aligned with each other. The first preparation feature 904 forms a hole in the web 900, while the second preparation feature 906 forms a perforation in the web 900. The first and second preparation features 904, 906 are applied by a cutting unit 100 according to what has been described above with reference to FIGS. 1-8.

Figure 10:
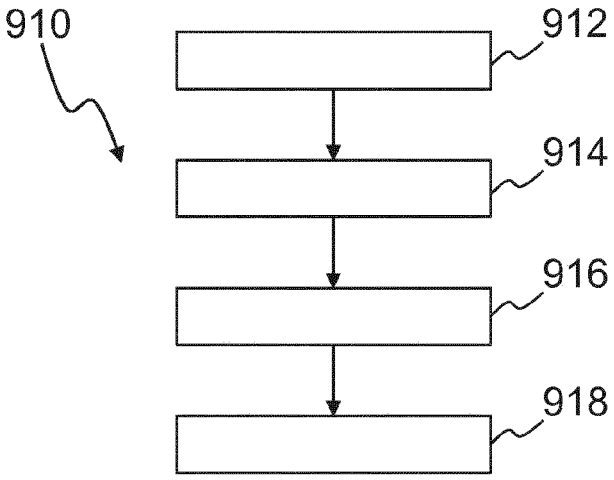
FIG. 10 is a schematic view of a method according to an embodiment.

In FIG. 10 an embodiment of a method 910 is schematically shown. The method 910 is performed in order for cutting preparation features in a web of sheetlike material. The method 910 comprises a first step 912 of receiving a web of sheetlike material at a cutting and/or creasing station; and a second step 914 of passing the web of sheetlike material between a first and a second part of a cutting unit, located at a first and second cutting and/or creasing rolls. The first part comprises at least one first and at least one second cutting tool and the second part comprises an anvil against which the web of sheetlike material and the first part is pressed. The method also comprises a step 916 of pressing the two cutting and/or creasing rolls against the web of sheetlike material and against each other, and a step 918 of producing at least one first and one second preparation feature aligned with each other. In this method at least one of the first or second cutting tools are supported by a flexible support.

The invention claimed is:

1. A cutting unit for cutting preparation features in a web of sheetlike material, said cutting unit comprising:

a first part with a rigid base portion, at least one first cutting tool configured to cut a first preparation feature in the web of sheetlike material, at least one second cutting tool configured to cut a second preparation feature in the web of sheetlike material;

the at least one first cutting tool and the at least one second cutting tool located at a distance from each other;

wherein the at least one first cutting tool and the at least one second cutting tool are supported by a first flexible support and a second flexible support respectively, the first flexible support and the second flexible support located in the rigid base portion of the first part and each having a surface configured to face toward a second part configured, in operation, to cooperate with the first part and the web of sheetlike material therebetween such that the first and second parts produce at least two preparation features on the web of sheetlike material;

wherein the at least one first cutting tool is disposed on the surface of the first flexible support and is configured to extend perpendicularly away from the surface of the first flexible support towards the second part such that a cutting surface of the at least one first cutting tool is disposed between the first flexible support and the second part; and wherein the at least one second cutting tool is disposed on the surface of the second flexible support and is configured to extend perpendicularly away from the surface of the second flexible support towards the second part such that a cutting surface of the at least one second cutting tool is disposed between the second flexible support and the second part;

wherein a hardness of a material of the first flexible support is different than a hardness of a material of the second flexible support.

2. The cutting unit according to claim 1, further comprising the second part with at least one first rigid base portion.

3. The cutting unit according to claim 2, wherein the at least one first rigid base portion in the second part is supported by a flexible support different from the first flexible support and the second flexible support in the rigid base portion of the first part.

4. The cutting unit according to claim 1, wherein the first part comprises at least one third cutting tool configured to cut a third preparation feature in the web of sheetlike material, wherein the third preparation feature is different from the first and second preparation features.

5. The cutting unit according to claim 4, wherein the at least one third cutting tools is supported by a third flexible support and wherein a hardness of a material of the third flexible support is different than the hardness of the materials of the first and second flexible supports.

6. The cutting unit according to claim 1, wherein the at least one first cutting tool comprises a cylindrical shape and protrudes from the rigid base portion.

7. The cutting unit according to claim 1, wherein the at least one second cutting tool comprises a plurality of protrusions circularly or elliptically arranged at a distance from each other.

8. A web of sheetlike material comprising a plurality of crease lines along which the web of sheetlike material is configured to be folded into a container, the web of sheetlike material further comprising the first and the second preparation features aligned with each other, the first and second preparation features being applied by the cutting unit according to claim 1.

9. A cutting unit for cutting preparation features in a web of sheetlike material, said cutting unit comprising:

a first part with a rigid base portion, at least one first cutting tool configured to cut a first preparation feature in the web of sheetlike material, at least one second cutting tool configured to cut a second preparation feature in the web of sheetlike material;

at least one third cutting tool configured to cut a third preparation feature in the web of sheetlike material;

the at least one first cutting tool, the at least one second cutting tool, and the at least one third cutting tool being attached to the rigid base portion of the first part, located at a distance from each other;

wherein the at least one first cutting tool, at least one second cutting tool, and the at least one third cutting tool are supported by a first flexible support, a second flexible support, and a third flexible support respectively, wherein the first flexible support, the second flexible support, and the third flexible support are located in the rigid base portion of the first part, and each having a surface configured to face toward a second part configured, in operation, to cooperate with the first part and the web of sheetlike material therebetween such that the first and second parts produce at least three preparation features on the web of sheetlike material;

wherein the at least one first cutting tool is disposed on the surface of the first flexible support and is configured to extend perpendicularly away from the surface of the first flexible support towards the second part such that a cutting surface of the at least one first cutting tool is disposed between the first flexible support and the second part;

wherein the at least one second cutting tool is disposed on the surface of the second flexible support and is configured to extend perpendicularly away from the surface of the second flexible support towards the second part such that a cutting surface of the at least one second cutting tool is disposed between the second flexible support and the second part;

wherein the at least one third cutting tool is disposed on the surface of the third flexible support and is configured to extend perpendicularly away from the surface of the third flexible support towards the second part such that a cutting surface of the at least one third cutting tool is disposed between the third flexible support and the second part; and wherein a hardness of a material of the first flexible support, a hardness of a material of the second flexible support, and a hardness of a material of the third flexible support are different from each other.

10. A method of cutting preparation features in a web of sheetlike material, comprising:

receiving a web of sheetlike material at a cutting and/or creasing station;

passing the web of sheetlike material between a first and a second part of a cutting unit, located at a first and a second cutting and/or creasing roll, wherein the first part of the cutting unit comprises at least one first cutting tool and at least one second cutting tool, and wherein the second part of the cutting unit comprises an anvil against which the web of sheetlike material and the first part of the cutting unit is pressed;

pressing the first and second cutting and/or creasing rolls against the web of sheetlike material and against each other; and producing at least one first preparation feature and at least one second preparation feature aligned with each other, wherein the at least one first cutting tool and the at least one second cutting tool are respectively disposed on a surface of a first flexible support configured to face toward the second part and on a surface of a second flexible support configured to face toward the second part, wherein the at least one first cutting tool is configured to extend perpendicularly away from the surface of the first flexible support towards the second part such that a cutting surface of the at least one first cutting tool is disposed between the first flexible support and the second part, wherein the at least one second cutting tool is configured to extend perpendicularly away from the surface of the second flexible support towards the second part such that a cutting surface of the at least one second cutting tool is disposed between the second flexible support and the second part, and wherein a hardness of a material of the first flexible support is different than a hardness of a material of the second flexible support.

* * * * *